United States Patent [19]

Shuman

[11] Patent Number: 4,721,479

[45] Date of Patent: Jan. 26, 1988

[54] SAFETY JUMPER CABLES

[76] Inventor: Curtis Shuman, 11600 N. 10575 W., Tremonton, Utah 84337

[21] Appl. No.: 920,696

[22] Filed: Oct. 17, 1986

Related U.S. Application Data

[63] Continuation-in-part of Ser. No. 676,774, Nov. 19, 1984, abandoned.

[51] Int. Cl.[4] ..... H01R 11/00

[52] U.S. Cl. ..... 439/503; 439/504; 439/505

[58] Field of Search ..... 339/29 B, 29 R, 28

[56] References Cited

U.S. PATENT DOCUMENTS

| | | | |
|---|---|---|---|
| 4,272,142 | 6/1981 | Zapf | 339/29 B |
| 4,366,430 | 12/1982 | Wright | 339/29 B |
| 4,431,925 | 2/1984 | Frisbee et al. | 439/504 |
| 4,496,204 | 1/1985 | Conley | 339/29 B |

*Primary Examiner*—Gil Weidenfeld

*Assistant Examiner*—Paula A. Austin

*Attorney, Agent, or Firm*—Thorpe, North & Western

[57] ABSTRACT

A pair of jumper cables for connecting between weak and strong batteries for transmitting power to jump-start a vehicle wherein the cables include a protective feature to isolate an electric spark from the general area of the batteries to prevent explosion. The cables comprise a first, continuous conductor cable adapted with clamps for attachment to the negative terminals or ground voltage of the respective batteries. A second, two-segment insulated conductor cable is provided having two medial and two distal ends, wherein each of the distal ends includes a conductive clamp for attachment to the positive terminals of the battery. The remaining medial ends of the positive cable are adapted for mutual, releasible attachment by an alligator clamp fixed at one of the medial ends. The remaining medial end is configured in size and shape to permit its firm grip within the opposing medial clamp.

3 Claims, 2 Drawing Figures

SAFETY JUMPER CABLES

This is a continuation-in-part application of application Ser. No. 06/676,774 filed on Nov. 19, 1984, now abandoned.

BACKGROUND OF THE INVENTION

1. Field of the Invention:

This invention pertains to jumper cables which are used between motor vehicles to restore power to a discharged battery and to jump-start the vehicle engine. More particularly, the present invention relates to jumper cables which have an intermediate open circuit device between clamps at the respective ends of the cables.

2. Prior Art:

Jumper cables or battery booster cables comprise a pair of insulated cables with attached connector devices used as a temporary connection to transfer energy from a charged battery to a discharged battery. Because of the millions of motor vehicles which depend upon battery ignition for engine start, the use of jumper cables to boost power on weak batteries is very common. Unfortunately, many of those using jumper cables are not adequately trained in proper safety procedures. As a consequence, many injuries occur to unsuspecting persons who are unaware of the hazard of jump-starting a vehicle. The seriousness of the problem can be appreciated by the fact that approximately 5% of the more than 40,000 people losing their sight annually are the victims of battery-exploding accidents. This does not take into account the untold thousands that suffer minor injuries in unreported accidents.

In 1978 a study entitled Battery Explosion Tests and Labeling DOT HS-803 665 was completed pursuant to a research contract under the Federal Department of Transportation. The study was done by the Society of Automotive Engineers, Inc. in concert with a task force made up of persons from the Society of Automotive Engineers (SAE) Technical Committees on electrical distribution systems, including representatives of manufacturers, government and public users. As part of this study, SAE reviewed and analyzed data regarding reported battery-explosion and related accidents which was provided by the U.S. Consumer Product Safety Commission.

The government sponsored study revealed that "The preponderance of accident and test data indicate that most explosions are caused by the introduction of an ignition source such as a spark or flame from outside the battery. The ignition source must be placed in a flammable zone of venting hydrogen, which occurs within approximately one to two inches of the point of exit of the gas from the battery's ullage space." DOT report, Page 2–13. Upon ignition, the flame propogates into the interior of the battery cell, causing detonation of the contained hydrogen-rich mixture. Battery acid and casement fragments are blown into the face of the unsuspecting victim.

In the typical battery explosion, the igniting shower of sparks is caused by connection of booster cables to the battery terminals. As the circuit is closed by attachment of the terminal, very high currents attempt to bridge the comparatively high resistance area of the contact between the clamp and terminal, causing intense, localized heating. This results in melting and boiling of the mated metallic surfaces, causing whitehot, molten metal particles to be ejected. If these fall into the ignition region of the cells, explosion is likely. This condition of molten sparks is much greater when the booster cables are improperly reversed or cross-connected between two 12-volt batteries, creating an electrical equivalent of a 24-volt, direct short circuit. The commissioned study revealed that 98.6% of the studied battery accidents could be traced to hydrogen gas ignition. Id. Page 2–18.

The subject research contract proposed that a battery booster cable standard be developed that would minimize (i) short circuits, (ii) reverse polarity connections (iii) arcing at the point of connection and (iv) would be suitable for top and side terminal mounts. The project resulted in the following proposed industry standard for booster cables.

a. Conductors and insulation shall be in accordance with SAE Standard J1127 or J1128;

b. The two cables and attached clamps should be of contrasting colors and permanently identified positive and negative.

c. The cable and connectors shall be a minimum of eight feet long, tip to tip.

d. A durable label is to be attached to the cables to provide proper instructions for use, including an instruction that the final connection is to be made to the block of the engine away from the battery.

Although this instructional approach to solving the risk of battery explosion is useful, it does not impose a structural change to the standard jumper cable configuration used for more than fifty (50) years. No structure is added to the cable to enhance or adapt it for proper safety procedures. Obviously this recommendation assumes that education will be adequate to avoid injury. Unfortunately, this approach does not take into account the inclination of the typical consumer to overlook instructions, particularly if they involve numerous steps. Furthermore, it is well known that the normal circumstances requiring use of jumper cables include adverse conditions of cold, rain, snow and darkness. Such situations do not lend themselves to a careful, academic approach to jump-starting a car. In fact, even well trained persons frequently overlook known safety precautions and carelessly connect the booster cables to the wrong terminal.

The need for a structure safety element formed as part of the jumper cables is evident from the following U.S. Pat. Nos.:

4,006,952; Puckett
3,700,834; Schaefer
2,908,827; Hickman
3,942,027; Fima

Each of these patents disclose a jumper cable system which is adapted for service vehicles. Such cables are typically connected by experienced mechanics who understand the risks of battery explosion and work daily with the problem. Nevertheless, the need to isolate the electrical point of contact of clamps from the battery and otherwise ensure proper polarity is promoted for this more knowledgeable class. This fact also rises further question as to the reasonableness of the "educational" approach of the government. The fact that experienced persons could benefit from improved safety features within an improved jumper cable suggests that a layman who makes only occasional use of such cables should also be protected with a safety cable.

Unfortunately, the cable systems disclosed in the referenced patents are too expensive for the typical consumer. The high cost is particularly impractical when consumer use is so infrequent. Balancing the risk of injury versus the high-cost of a safety cable usually leads a consumer to purchase a cheap cable that hopefully will never be used, but will be there if needed. Accordingly, the above mentioned prior art has failed to recognize a need for a consumer safety cable which is inexpensive but which includes means to isolate the possible ignition spark that triggers an explosion.

U.S. Pat. No. 4,163,134 of Budrose discloses various embodiments of a consumer-related jumper cable; however, many of the typical prior art perceptions have been carried forward into this structure. For example, Budrose utilizes an open circuit device in one of the cables to prevent the user from closing the circuit upon direct attachment of the cable clamps to the battery or vehicle. A variety of switching devices is disclosed for interposing within the cable line. These devices do not, however, ensure that the user will make use of their safety, open-circuit feature. For example, an anxious user may disregard checking the open or closed status of the switch before hurridly attaching the clamps. In adverse weather or darkness, the actual switch position may not be easily seen. Furthermore, the cable system of Budrose has incorporated features which likely place the cost of the safety cables out of reach for typical consumer budgets. From a technical point of view, the circuitry of Budrose includes a different switching element which further complicates the use of the jumper cables. This added element requires even further education of the user beyond that proposed by the government study.

U.S. Pat. No. 4,366,430 by Wright discloses another approach to the problem. The Wright patent suggests insertion of a switch in one of the cables for testing voltage levels at the clamps to determine if the cables have been correctly coupled to the respective positive and negative leads of the batteries. Incorrect attachment prevents final closing of the circuit by means of a mechanical or electrical lockout. This structure fails, however, to deal with several of the significant problems that arise with jumper cable use. For example, the Wright structure still develops a small spark at the battery terminals as the final connections are made. This spark arises because the testing circuit draws a small amount of current to determine the relative voltage levels at the terminals. If the hydrogen envelope at the battery reaches the spark, explosion is likely. With the Wright structure, this small spark occurs each time the jumper cables are coupled—whether correctly or incorrectly. Therefore, the risk of explosion remains with every attachment of the Wright cables.

A second problem which occurs with all the prior art cables is inadvertent grounding between vehicles by bumper contact. When the two vehicles are brought together to permit jumper cables to reach the respective batteries, contact may occur at the bumper or any other part of the vehicles which effectively grounds the vehicles. When the first cable is attached between positive terminals, the attending individual may be startled with an unexpected arc and high risk of explosion. With the cars in such grounding contact, the attachment of one cable to the positive terminals closes the circuit, much to the surprise of the attendant. Accordingly, the ability of Wright to permit interchangeable connection of cables between either positive and negative terminals, the existence of other cables which have the continuous cable for the positive connection, create an unknowing risk of explosion with use of only a single cable coupling.

It is clear that the market has yet to find a reasonable solution for the average consumer in the field of jumper cable safety devices. The conventional jumper cable of the past fifty (50) years (without any safety structure) remains the dominant product for the consumer. Likewise, the government proposals offer little hope of change in the adoption of safety practices which would reduce the occurrance of blindness and other injuries resulting from battery explosions. What is needed therefore is a jumper cable which (i) includes an open circuit mechanism, (ii) does not add excessive expense to discourage its purchase and (iii) does not add new safety devices that require further training or education on the part of the user.

OBJECTS AND SUMMARY OF THE INVENTION

It is an object of the present invention to provide jumper cables which may be connected at its distal ends to the respective batteries to be coupled, yet which does not develop any current flow until the circuit between positive terminals is closed at an intermediate section of the jumper cables.

It is a further object of the present invention to provide jumper cables which may be connected at their ends between batteries of two respective cars, with intermediate set of clamps unattached, at least within the positive cable to prevent current flow until all contacts between the respective batteries have been properly set and checked.

It is a further object of the present invention to provide jumper cables which avoid the risk of hydrogen explosion caused from sparks at the battery terminals.

It is a further object of the present invention to provide an inexpensive set of jumper cables which avoid the expense and complication of prior art switching systems, yet which provides safety against inadvertent and unsafe practices when jump-starting automobiles without the need of further education to the consumer.

These and other objects are realized in a pair of jumper cables used to couple a strong battery to a weak battery as a source of power for starting a combustion engine in an automobile or truck. The cables include a first, continuous insultated conductor cable which has conductive clamps attached at each end thereof and is adapted for attachment between negative terminals or ground voltage of the respective batteries. A second, two-segment, insulated conductor cable has two distal ends with two additional medial ends therebetween. The distal ends include conductive clamps attached thereto which are adapted for fixation between the positive terminals of the respective batteries. The respective medial ends are adapted for mutual attachment to close the circuit between the respective batteries and develop power transmission after both sets of distal clamps have been properly attached. One of the medial ends comprises an exposed cable and the other medial end has an attached conductive allegator clamp which can be releasibly affixed to the opposing exposed medial end.

By interrupting or segmenting the positive lead with a clamp-attachment system, one can realize significant safety benefits without a significant increase in costs. Use of an intermediate or medial clamp similar to the end clamps provides a device which is already within the experience and understanding of the public. No complicated instructions or procedures are required explain the use of the clamp and to protect against the risk of battery explosion. In addition, the existence of the 5th clamp in the positive terminal provides a physical reminder to the person using the jumper cables to check before final closing of the circuit to ensure that the segmented-positive cable is coupled to the positive terminal of each battery.

Both cables may be segmented to require medial attachment between clamps or other coupling means. This would prevent any possibility of sparks near the batteries in the event of inadvertent attachment between positive leads of the batteries. Such sparks would be removed to a central space between the vehicles. By displacing the attachment clamps or plugs at different lengths along the positive and negative cables, electrical contact between clamps is unlikely. The use of male-female plugs on alternating medial ends of the cables will prevent inadvertent attachment of positive to negative leads.

Other objects and features of the present invention will be apparent to those skilled in the art based upon the following detailed description, taken in connection with the attached drawing wherein.

DETAILED DESCRIPTION OF THE INVENTION

Figure 1:
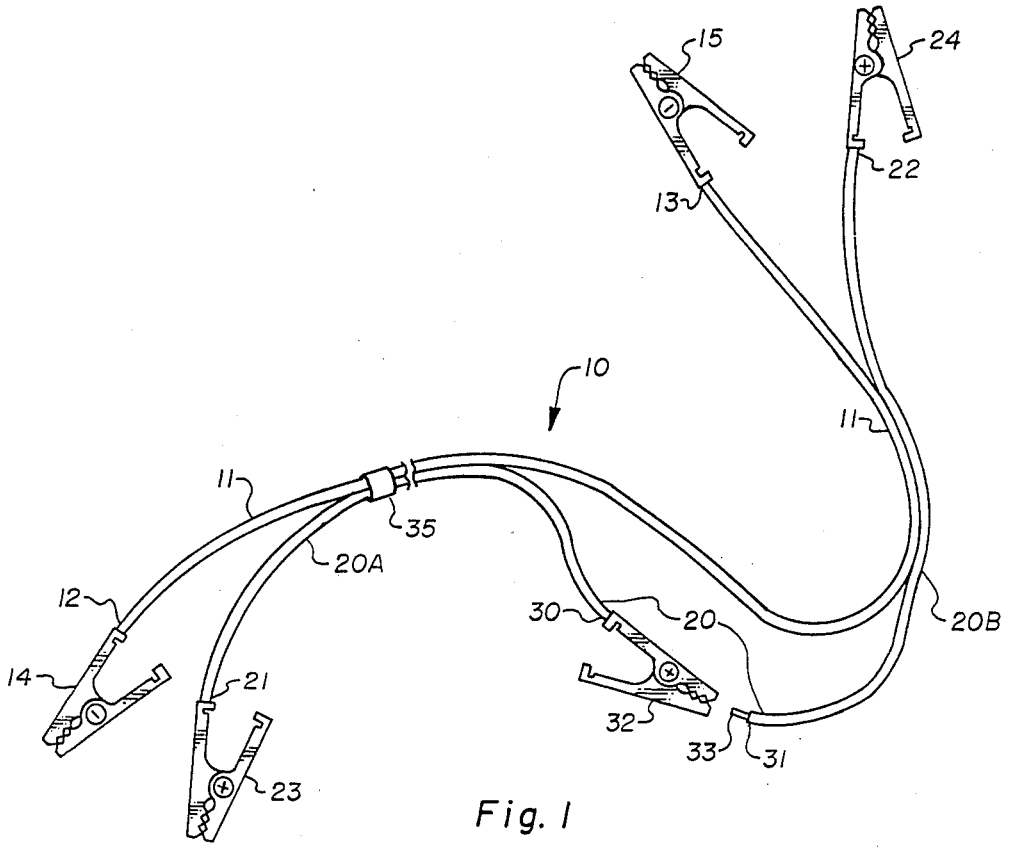
FIG. 1 shows a preferred embodiment of the subject invention having an intermediate clamp to control current flow.

FIG. 1 illustrates a first embodiment comprising a pair of jumper cables 10 which include a first, continuous insulated conductor cable 11. This continuous cable 11 will be hereafter described as the "ground cable". It is adapted for connecting between the respective negative or ground potential terminals of the batteries to be used, or to the grounded frame or block of the vehicle. The distal ends 12 and 13 of the ground cable 11 are attached to alligator clamps 14 and 15. These clamps are conventional clamps used with typical jumper cable devices. The handle portions of each respective clamp 14 and 15 are spring-biased to a closed position to provide a firm grip at the battery terminal.

A second conductive cable 20 is divided into two separate cable segments, 20A and 20B. This segmented cable is referred to hereafter as the "positive cable" and is designed for attachment to the positive terminals on the respective batteries. The positive cable 20 includes distal ends 21 and 22 which have alligator clamps 23 and 24 attached at their respective locations. The configuration and clamp structure on the distal ends 21 and 22 of the positive cable are substantially the same as the clamp assemblies 14 and 15 on the ground cable 11.

A primary inventive feature of the subject structure is a releasible attachment clamp disposed along the intermediate length between distal ends 21 and 22 of the positive cable 20. These distal ends are clearly marked with "+" symbols to indicate proper attachment to the positive battery terminals. This intermediate structure includes two medial ends 30 and 31 which are positioned intermediate between the two distal ends 21 and 22. One segment of the positive cable 20A has an alligator clamp 32 attached to its distal end 30. This alligator clamp is much like the clamps attached at the respective distal ends 12, 13, 21 and 22 of the jumper cables.

The remaining medial end 31 has an exposed cable end 33 which can make electrical contact with the clamp 32. When firmly clamped at the exposed cable 33, the clamp 32 serves as a releasible attachment which can be used to selectively open or close the conductive circuit between the respective batteries to which the jumper cables are attached. The exposed cable 33 may be soldered or otherwise solidified to prevent fraying of woven wire making up the cable. This solidified structure also improves the electrical contact with clamp 32. It will be apparent to those skilled in the art that other coupling means may be substituted for medial clamps without departing from the concept of introducing a total open circuit to the positive lead.

The method of use of the subject invention involves the following steps. First, the intermediate or medial clamp 32 is checked to make sure that the clamp is positioned free from the exposed end 33 of the positive cable. For example, it may be secured to a protective pad 35 by merely clamping the jaws of the clamp around the pad structure. After checking to ensure that no electrical contact will inadvertently occur between the clamp 32 and exposed end 33, the respective ends of the jumper cable are attached to the batteries. Clamp 15 is attached to the grounded frame or negative terminal of the battery in one of the vehicles, with the positive clamp 24 being attached to the positive terminal of the same battery. Corresponding connections are made at the other end of the jumper cables, with clamp 14 being attached to the negative terminal or grounded frame of the vehicle, and clamp 23 being attached to the positive battery terminal. Up to this point, no current flows because of the open circuit in the positive cable 20 between the respective batteries. This prevents occurrence of any spark at the battery terminals. An additional significant advantage of the present invention is a forced opportunity to reinspect the connections to ensure that the positive clamps 23 and 24 are each attached at the respective positive terminals of the battery.

Because no current flows through the system to this point, no risk of explosion or injury has resulted. After confirming the safety of the connections, the person then grasps the medial clamp 32, releasing it from its protective pad 35 and affixes the jaws of the clamp 32 to the exposed end 33 of the positive cable. This connection is made at a safe distance from each of the respective batteries, typically midway between vehicles by virtue of the medial location of the clamp between the respective ends of the jumper cable. Therefore, any spark which occurs is isolated from the hydrogen which may be present at either of the batteries. Typically, little sparking will occur, provided the positive cable 20 is attached between the respective positive terminals of the batteries. In addition, the placement of an extra clamp within the positive cable, eliminates the possibility of explosion through inadvertent grounding of one vehicle to the other by touching of bumpers. The added markings on the terminal clamps 23 and 24 further ensure that only the positive cable is attached to positive battery terminals.

When the charging operation is complete, the person simply releases the jaws of the medial clamp 32 from the exposed end 33 and replaces it at the protective pad 35. The jumper cables are then free of any conductive current and may be released from the batteries without further risk of explosion or shock.

A second embodiment of the invention incorporates the disclosed segmented structure in the ground cable as well. Many foreign vehicles use batteries with reversed polarity. In otherwords, the positively marked terminal actually operates as ground. To compensate for this unknown condition, both jumper cables are segmented with medial attachment means located between the terminal clamps.

Figure 2:
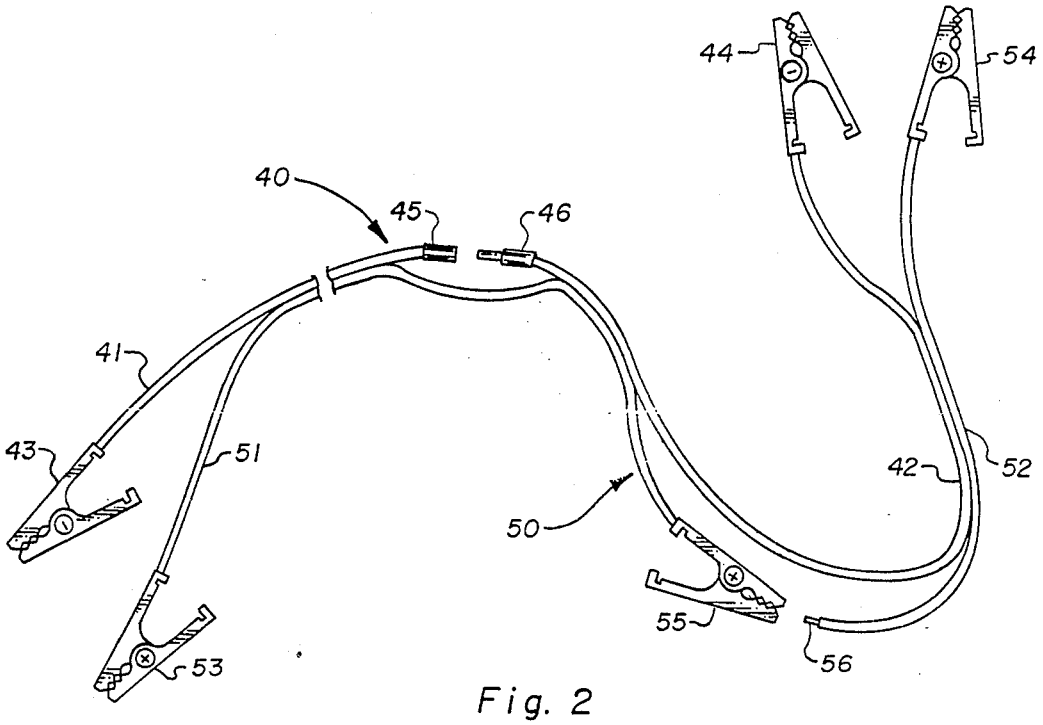
FIG. 2 is a representation of a second embodiment of the present invention having both cables segmented with medial attachment means.

FIG. 2 illustrates an example of this structure. Ground 40 includes two segments 41 and 42. Terminal clamps 43 and 44 are also provided and operate as explained for the first embodiment. Separated medial coupling means 45 and 46 provide the required open circuit to prevent any current flow which might arise from incorrect attachment to the battery terminals and inadvertent grounding of the vehicles by vehicle contact.

The positive cable 50 is configured in accordance with the first embodiment. It includes two cable segments 51 and 52 which have terminal clamps 53 and 54. A medial clamp 55 and exposed medial end 56 are positioned at medial ends of each respective positive cable segment. The use of a different form of medial clamp on the positive and ground cables prevents inadvertent attachment of positive medial ends to ground medial ends. By displacing or separating these respective medial clamps along the length of the jumper cable, the likelihood of accidental contact is minimized. Insulative shields can be positioned around each clamp or plug section to further avoid adverse contact.

The manner of use for this second jumper cable is similar to the first. The vehicles are first brought into proximate position without making physical contact. Clamps 43 and 53 are attached to the first vehicle battery with clamp 53 being coupled to the positive terminal in accordance with the positive symbol on the claim body. Clamps 44 and 54 are likewise attached to proper terminals of the second vehicle battery. The grounding clamp or plugs are then coupled. This will typically be male and female coupling members 45 and 46, except where foreign batteries of reverse polarity are being used. In this case the exposed end 56 is secured in clamp 55. The last connection is to couple the remaining positive medial attachment means together. Following recharging operations, the system is uncoupled in the reverse order of assembly.

The present invention offers many advantages over prior art attempts to isolate a switch for closing the circuit between the connected batteries. Whereas the prior art attempts have been very costly or have involved some risk of spark and explosion, the present invention represented by FIG. 1 involves little or no cost than the additional clamp placed within the medial section of the positive cable 20. Because of the common structure and function of the medial clamp, as compared to distal clamps 14, 15, 23 and 24, the user readily understands the simple operation of the medial connection with exposed end 33. Although the disclosed clamp and exposed end structure for the positive cable are not the customary type of switching system for electrical circuits, they present an unusual and favorable solution to the jumper cable problem, based on the simplicity of use within the public's experience, as well as the economical factor which enables the general public to afford such a safety feature.

Even greater advantage occurs with the second embodiment having both cables segmented, thereby dividing the jumper cable into two halves. With both positive and ground cables segmented at the time of attachment to the battery terminals, little chance of sparking occurs near the battery hydrogen envelope, regardless of whether the vehicles have been grounded by contact or even if the battery polarities are opposite. The only sparking that can occur would be between the vehicles at the point of attachment of the medial attachment means. This extra safety arises from having a total open circuit as disclosed in the present invention. Surprisingly, this open circuit is developed without complicated circuitry and without significant increase in cost for the consumer.

I claim:

1. A pair of jumper cables for coupling between weak and strong batteries used as sources of power for starting combustion engines wherein the cable provides a transmission line for conducting power from the strong battery to the weak battery, said battery cables comprising:

a first insulated conductor cable for attachment between positive terminals of the respective batteries, said first cable including two cable segments, each having a conductive clamp at a distal end which is adapted for attachment to the battery terminal and an attachment means coupled at a remaining medial end, said attachment means being adapted for establishing an electrical connection between the respective conductive distal clamps when in a coupled configuration while providing an open, nonconducting circuit when in a noncoupled configuration; and a second insulated conductor cable for attachment between negative terminals of the respective batteries, said second cable including two cable segments, each having a conductive clamp at a distal end which is adapted for attachment to the battery terminal and an attachment means coupled at a remaining medial end, said attachment means being adapted for establishing an electrical connection between the respective conductive distal clamps when in a coupled configuration while providing an open, nonconducting circuit when in a noncoupled configuration;

the attachment means for the first cable comprising an alligator clamp at one medial end for coupling to an exposed medial end of the same first conductive cable, said exposed end being adapted in size and shape for firm attachment by the alligator clamp;

the attachment means in the second cable comprising a detachable plug and receptacle respectively coupled to the medial ends of the second conductive cable and adapted to mate for closing a conductive path between the distal clamps of the cable.

2. A pair of jumper cables as defined in claim 1, wherein the respective attachment means are displaced along the length of the cables such that any portion of the second cable which is next to the attachment means of the first cable is insulated and is free of any form of attachment means.

3. A pair of jumper cables for coupling between weak and strong batteries used as sources of power for starting combustion engines wherein the cables provide a transmission line for conducting power from the strong battery to the weak battery, said jumper cables comprising:

a first, continuous insulated conductor cable having a conductive clamp attached at each thereof and being adapted for attachment between negative terminals or ground voltage of the respective batteries;

a second insulated conductor cable comprising first and second cable segments, the first cable segment having a conductive clamp attached at a distal end, the remaining end being a medial end and having conductive attachment means coupled thereto, wherein the attachment means is an alligator clamp;

the second insulated conductor cable segment having a conductive clamp attached at a distal end, the remaining end being a medial end including means for coupling to the attachment means wherein the means for coupling to the attachment means in an exposed medial end;

the first and second cable segments having no electrical contact, except during actual recharging operations wherein the medial ends of each cable segment have been electrically coupled together;

the attachment means being disposed along the length of the second cable and every portion of the first cable being free of any means of electrical connection with the attachment means.

* * * * *